US011374369B2

(12) United States Patent
Tsuchiya et al.

(10) Patent No.: US 11,374,369 B2
(45) Date of Patent: Jun. 28, 2022

(54) CONNECTOR

(71) Applicant: SMK Corporation, Tokyo (JP)

(72) Inventors: Hirotaka Tsuchiya, Tokyo (JP); Norihide Taguchi, Kanagawa (JP); Tadahito Sasaki, Kanagawa (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 17/023,375

(22) Filed: Sep. 17, 2020

(65) Prior Publication Data

US 2021/0273384 A1 Sep. 2, 2021

(30) Foreign Application Priority Data

Feb. 27, 2020 (JP) ..... JP2020-032273

(51) Int. Cl.
*H01R 24/40* (2011.01)
*H01R 13/05* (2006.01)
*H01R 103/00* (2006.01)

(52) U.S. Cl.
CPC ..... *H01R 24/40* (2013.01); *H01R 13/052* (2013.01); *H01R 2103/00* (2013.01)

(58) Field of Classification Search
CPC ..... H01R 2103/00; H01R 24/56–568; H01R 24/40; H01R 13/052
USPC ..... 439/578
See application file for complete search history.

(56) References Cited

U.S. PATENT DOCUMENTS 3,976,352 A * 8/1976 Spinner ..... H01R 24/40 439/140
5,074,809 A * 12/1991 Rousseau ..... H01R 24/44 439/675
5,611,707 A * 3/1997 Meynier ..... H01R 13/6277 439/353
6,380,826 B1 * 4/2002 Palinkas ..... H01R 24/42 333/175
6,716,061 B2 * 4/2004 Pitschi ..... H01R 24/564 333/260

(Continued)

FOREIGN PATENT DOCUMENTS

DE 202015001331 U1 4/2015
JP 3653029 B2 5/2005

(Continued)

OTHER PUBLICATIONS

Extended European Search Report for European Patent Application No. 20198554.6, issued by the European Patent Office dated Feb. 18, 2021.

*Primary Examiner* — Gary F Paumen

(57) ABSTRACT

A connector includes: an internal contact disposed at an inner position in a radial direction; an external contact disposed at an outer position in the radial direction; and an insulator disposed between the internal and external contacts. At least one of the internal and external contacts includes, on one side in the axial direction, a mating part to be mated with a corresponding counterpart contact at a predetermined radial contact pressure. The insulator includes a first insulator part exposed to the one side in the axial direction, and a second insulator part disposed on the other side in the axial direction relative to the first insulator part. The first insulator part is made of an elastic material capable of being easily deformed elastically in the radial direction as compared to the second insulator part.

8 Claims, 18 Drawing Sheets

(56) References Cited

U.S. PATENT DOCUMENTS

| | | | | |
|---|---|---|---|---|
| 7,828,594 | B2 * | 11/2010 | Burris | H01R 13/5812 439/578 |
| 10,305,219 | B2 | 5/2019 | Zebhauser | |
| 10,601,191 | B2 * | 3/2020 | Yamazaki | H01R 24/54 |
| 2005/0272311 | A1 * | 12/2005 | Tsao | H01R 24/50 439/578 |
| 2007/0275584 | A1 * | 11/2007 | Keating | H01R 13/5219 439/271 |
| 2010/0233901 | A1 * | 9/2010 | Wild | H01R 13/6277 439/578 |
| 2015/0349454 | A1 | 12/2015 | Kunieda | |
| 2017/0271827 | A1 * | 9/2017 | Qin | H01R 24/40 |

FOREIGN PATENT DOCUMENTS

| | | | |
|---|---|---|---|
| JP | 2006344491 | A | 12/2006 |
| JP | 2009016178 | A | 1/2009 |
| JP | 2014138375 | A | 7/2014 |
| JP | 2015225766 | A | 12/2015 |
| JP | 2017041347 | A | 2/2017 |

* cited by examiner

CONNECTOR

CROSS REFERENCE TO RELATED APPLICATION

The contents of the following Japanese patent application are incorporated herein by reference, Japanese Patent Application No. 2020-032273 filed on Feb. 27, 2020.

FIELD

The present invention relates to a connector, and more particularly, to a connector including internal and external lines that constitute a transmission path and an insulator provided between these lines.

BACKGROUND

A transmission path, such as a coaxial cable, including an insulator provided between a central conductor and an external conductor has excellent signal transmission characteristics since inductance of the central conductor, which serves as a signal line, and capacitance (electrostatic capacity) between the conductors are constant for each unit length. A characteristic impedance Z (Ω) of the transmission path is set to a predetermined value corresponding to the values of the inductance L (H) and the capacitance C (F) for each unit length.

When such a transmission path is connected to other devices, failure in impedance matching to match the characteristic impedance of the transmission path with the reference impedance of such a device causes signal reflection at a boundary point of the transmission path where the characteristic impedance changes, resulting in waveform distortion.

In view of this, a connector whose transmission path is connected to other devices needs to avoid deterioration in characteristic impedance due to reflection.

Patent Literature 1 describes such a conventional connector. On the basis of the fact that capacitance is increased as an area over which internal and external contacts are opposed to each other in the radial direction in male and female connector members is increased, a distance between the internal and external contacts is reduced, or the permittivity of an insulator provided between these contacts is increased, a male pin contact portion is set to a high impedance region so as to compensate for a low impedance of a female socket connector portion for the purpose of adjusting a characteristic impedance ($Z=(L/C)^{1/2}$). In this manner, the connector can obtain good transmission characteristics (see paragraphs 0031, 0085, and 0086, for example, in Patent Literature 1).

CITATION LIST

Patent Literature

Patent Literature 1: Japanese Patent No. 3653029

SUMMARY

Technical Problem

With the conventional connector as described above, however, a gap is created between opposed faces of insulators in male and female connectors if variations in dimensions of each element or variations in mating angle, for example, occur in mating parts to create male-female mating. As a result of change in permittivity due to such discontinuity in the insulator layer, mismatch occurs in the characteristic impedance set constant along the transmission path, thus deteriorating the transmission characteristics.

In view of this, it is an object of the present invention to provide a connector capable of effectively reducing deterioration in characteristic impedance in mating parts and thus obtaining excellent transmission characteristics.

Solution to Problem (1) In order to achieve the foregoing object, an aspect of the present invention provides a connector including: an internal contact extending in an axial direction and disposed at an inner position in a radial direction; an external contact extending in the axial direction and disposed at an outer position in the radial direction; and an insulator disposed between the internal contact and the external contact. At least one of the internal contact and the external contact includes, on one side in the axial direction, a mating part to be mated with a corresponding counterpart contact at a predetermined radial contact pressure. The insulator includes a first insulator part exposed to the one side in the axial direction, and a second insulator part disposed on the other side in the axial direction relative to the first insulator part. The first insulator part is made of an elastic material capable of being easily deformed elastically in the radial direction as compared to the second insulator part.

With such a configuration of the aspect of the present invention, when the mating part of the at least one of the internal contact and the external contact is mated with the corresponding counterpart contact at the predetermined radial contact pressure, the first insulator part disposed on the one side in the axial direction can be easily deformed elastically. This can facilitate elastic deformation and elastic recovery for the mating of the mating part with the counterpart contact, and can effectively reduce the creation of a gap between the insulator and the internal contact or the external contact after the elastic recovery. As the result, deterioration in characteristic impedance due to permittivity change resulting from the creation of such a gap space can be effectively reduced.

(2) In the aspect of the present invention, the mating part may include a plurality of mating claw portions disposed on the one side in the axial direction and having a substantially divided cylindrical shape as a whole, and a supporting cylindrical portion for integrally supporting the plurality of mating claw portions at one ends thereof with a plurality of slits being interposed between the plurality of mating claw portions. The first insulator part may be disposed within a regional range closer to the one side in the axial direction than the supporting cylindrical portion.

In implementation with such a configuration, when the mating part is mated, the plurality of mating claw portions are bent in the radial direction to compress the first insulator part and elastically recovered together with the first insulator part. Thus, the mating operation can be facilitated, and the creation of a gap space between the insulator and the internal contact or the external contact can be reduced more effectively.

(3) In the aspect of the present invention, widths of the plurality of slits may each be set to have a larger width on a base end side of the plurality of mating claw portions supported by the supporting cylindrical portion and to have a smaller width on a tip side of the plurality of mating claw portions.

In implementation with such a configuration, a required bending amount and strength of the plurality of mating claw portions can be attained without providing, for example, a hole to cause stress concentration in the plurality of mating claw portions. In addition, the wider slit width can further facilitate the elastic deformation of the first insulator part in the radial direction, thereby making it possible to reduce the creation of a gap space between the insulator and the internal contact or the external contact more effectively. Furthermore, the application of a load to the second insulator part can be reduced more effectively.

(4) In the aspect of the present invention, one end face of the first insulator part may project more toward the one side in the axial direction than the external contact or the internal contact, and the internal contact may include a penetration part that penetrates the insulator, a projecting end part that projects more toward the one side in the axial direction than the first insulator part, and a protrusion that protrudes in the radial direction toward the first insulator part from the penetration part.

With such a configuration, an axial displacement of the first insulator part can be restricted by the protrusion of the internal contact even when the first insulator part is brought into elastic abutment with the counterpart insulator. Thus, no gap is created in the abutting portion, and no large load is applied to the second insulator part.

(5) In the aspect of the present invention, the first insulator part may have a relative permittivity equivalent to that of the second insulator part.

In this case, deterioration in characteristic impedance in the mating part can be effectively reduced.

(6) In the aspect of the present invention, the first insulator part may be integrally coupled to the second insulator part.

With such a configuration, the first insulator part can be disposed at a stable position and with a stable orientation so as not to create a gap in the insulator portion.

(7) Another aspect of the present invention provides a connector including a male connector member and a female connector member, each including: an internal contact extending in an axial direction and disposed at an inner position in a radial direction; an external contact extending in the axial direction and disposed at an outer position in the radial direction; and an insulator disposed between the internal contact and the external contact. The male connector member of the male and female connector members includes first and second male mating parts to be mated with corresponding counterpart contacts at a predetermined radial contact pressure. The female connector member of the male and female connector members includes first and second female mating parts to be mated with corresponding counterpart contacts at a predetermined radial contact pressure. The insulator of the male connector member includes a first insulator part exposed to one side in the axial direction, and a second insulator part disposed on the other side in the axial direction relative to the first insulator part. The first insulator part is made of an elastic material capable of being easily deformed elastically in the radial direction as compared to the second insulator part.

With such a configuration, the first insulator part of the male connector member can be easily deformed elastically when the male and female connector members are mated with each other. This can facilitate elastic deformation and elastic recovery for the mating of the male connector member with the corresponding counterpart contact, and can effectively reduce the creation of a gap between the insulator and the internal contact or the external contact. As the result, deterioration in characteristic impedance due to permittivity change resulting from the creation of such a gap space can be reduced.

(8) In the aspect of the present invention, one end of the first insulator part of the male connector member may project more toward the one side in the axial direction than the external contact of the male connector member.

In this case, since the one end of the first insulator part in the male connector member is brought into contact with the insulator of the female connector member earlier than the external contact. Thus, the insulators of the male and female connector members are disposed in a connected state via the first insulator part provided therebetween without any gap not only in the radial direction but also in the axial direction.

(9) In the aspect of the present invention, the internal contact of the male connector member may project more toward the one side in the axial direction than the first insulator part and the external contact of the male connector member to form the first male mating part, and the internal contact of the female connector member may include a first female mating part with a length in the axial direction larger than or equal to that of the first male mating part.

With the use of such a configuration, the shape and orientation of the first insulator part in the mated state of the male and female connector members can be stably maintained, and contact between the internal contacts of the connector members as well as contact between the external contacts thereof can be stably maintained.

According to the aspect(s) of the present invention, deterioration in characteristic impedance of the transmission path due to capacitor change resulting from crush or clearance of the insulators in the mating parts of the connector.

DESCRIPTION OF EMBODIMENTS

Embodiments of the present invention will be described below with reference to the drawings.

First Embodiment

FIGS. 1 to 6C illustrate a connector according to a first embodiment of the present invention.

The configuration of the connector will be described first.

Figure 1:
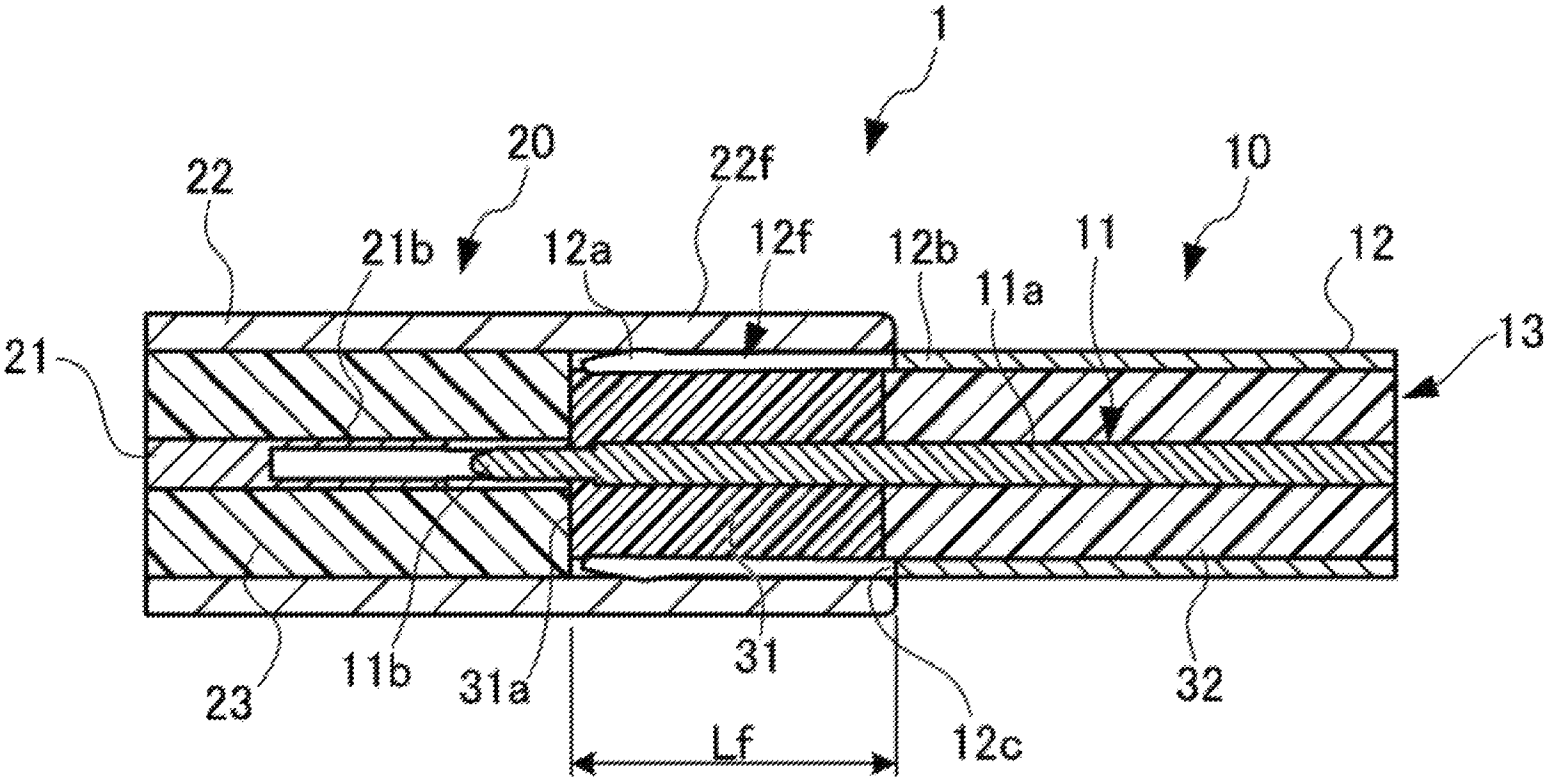
FIG. 1 is a longitudinal sectional view illustrating a part of a connector according to a first embodiment of the present invention.

As shown in FIG. 1, a connector 1 of the present embodiment includes a plug 10 and a receptacle 20 (which are a male connector member and a female connector member, respectively) each extending in an axial direction (i.e., the horizontal direction in FIG. 1). The connector 1 is configured so that the plug 10 can be engaged with the receptacle 20 (the female connector member) to have protrusion-recess mating with a shell mated depth Lf at their connection ends, and the plug 10 can be detached from the receptacle 20 to have an unmated state.

The connector 1 of the present embodiment has features in the structures of mating parts of the male and female connector members. The structures of end parts (a right end part of the plug 10 and a left end part of the receptacle 20 in FIG. 1) to be connected to, or mounted on, other devices, substrates, or cables as coaxial connectors or coaxial plugs, for example, are not limited to any particular structures. Any conventionally-known connecting or mounting structure can be employed. Although the detailed description and illustration of such a connecting structure to a coaxial cable or a device are herein omitted, known mounting structures onto printed circuit boards (see Japanese Patent Application Laid-Open No. 2017-41347, for example), known connecting structures between coaxial cables and device substrates (see Japanese Patent Application Laid-Open No. 2006-344491, for example), known surface mounting structures (see Japanese Patent Application Laid-Open No. 2009-16178, for example), known external connecting structures of antennas (see Japanese Patent Application Laid-Open No. 2014-138375, for example), and known connecting structures to precision devices (see Japanese Patent Application Laid-Open No. 2015-225766, for example) can be used, for example.

Figure 2:
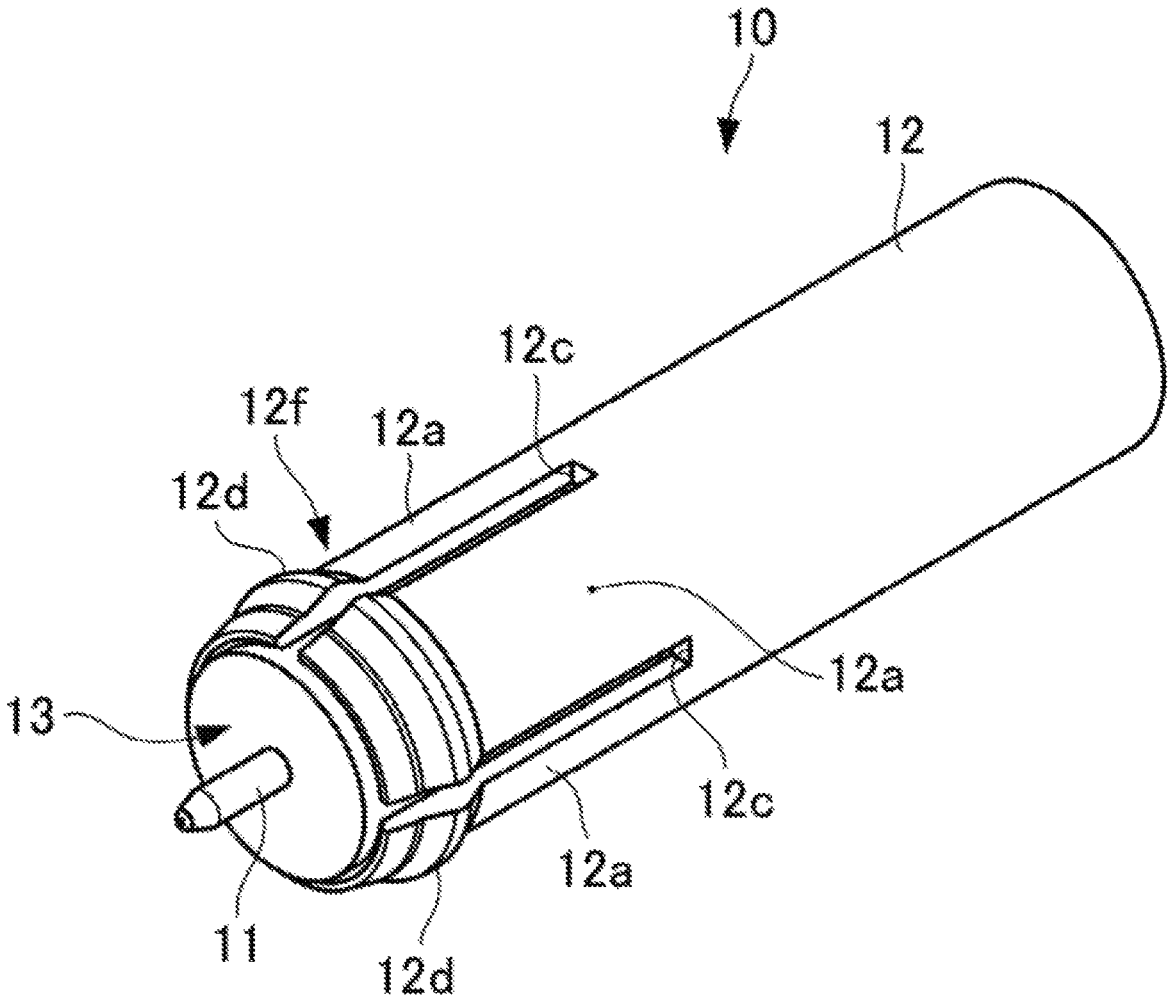
FIG. 2 is a perspective view illustrating a part of a plug in the connector according to the first embodiment of the present invention.
Figure 3A:
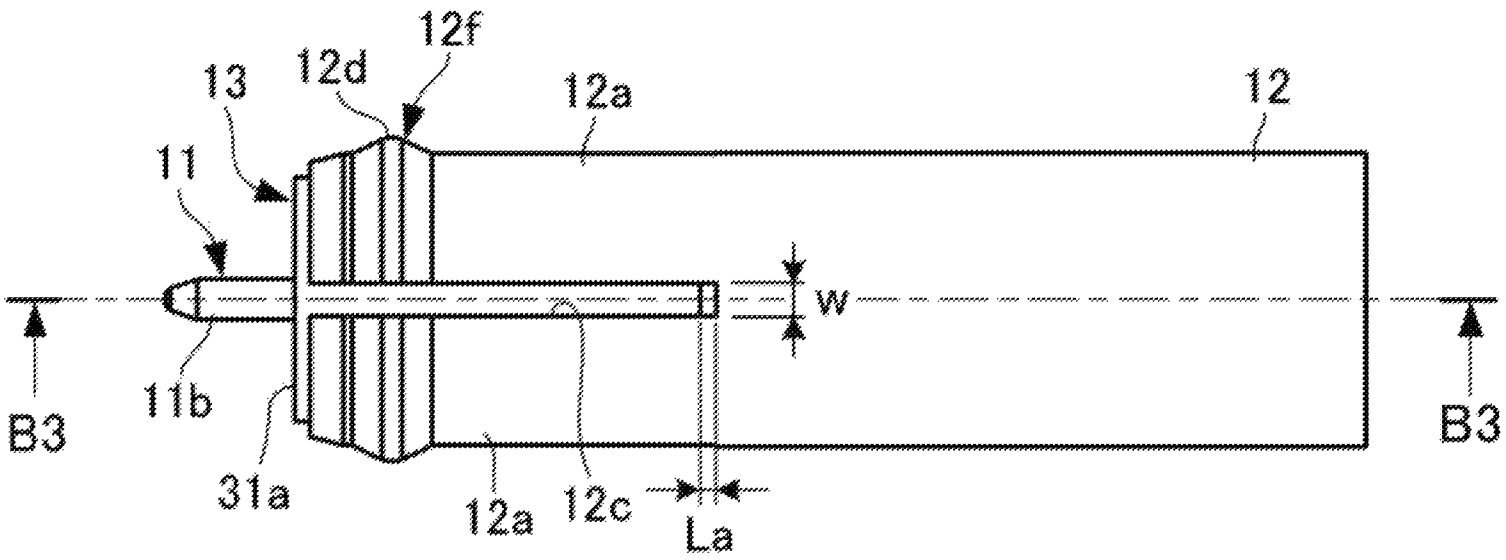
FIG. 3A is a side view illustrating the part of the plug in the connector according to the first embodiment of the present invention.
Figure 3B:
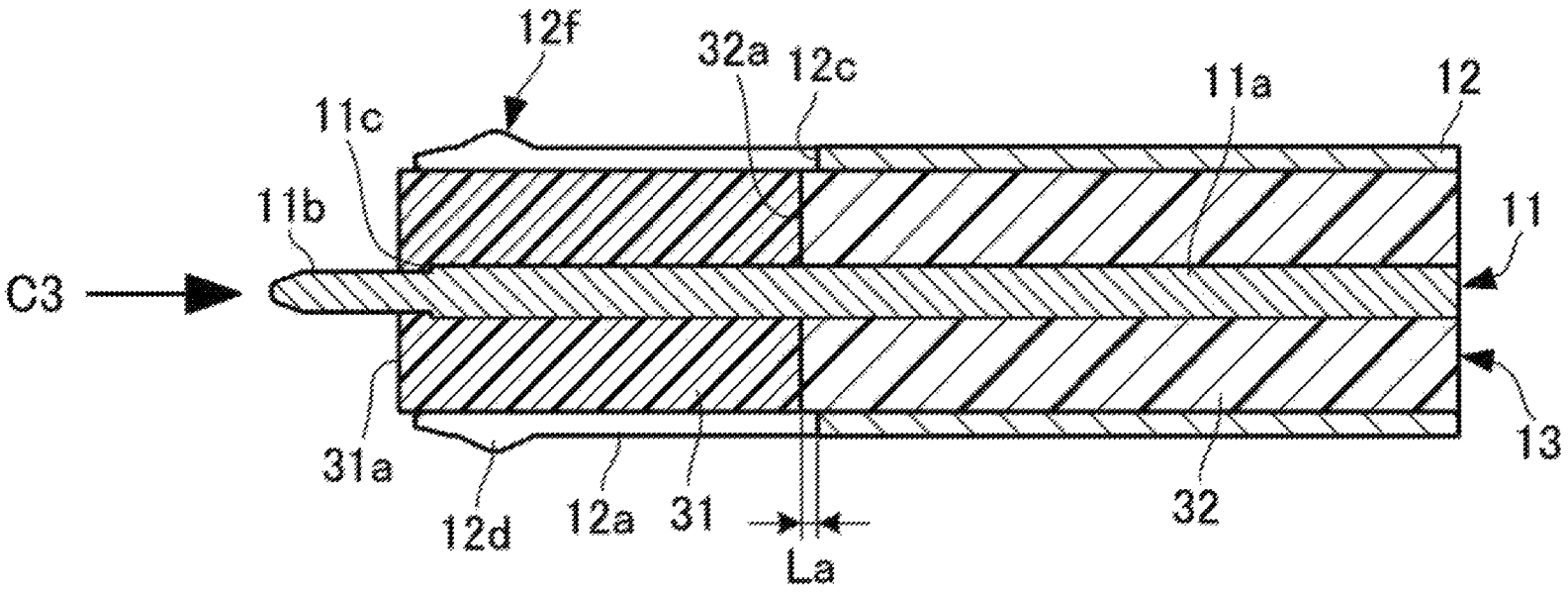
FIG. 3B is a cross-sectional view, viewed along arrows B3-B3 in FIG. 3A.
Figure 3C:
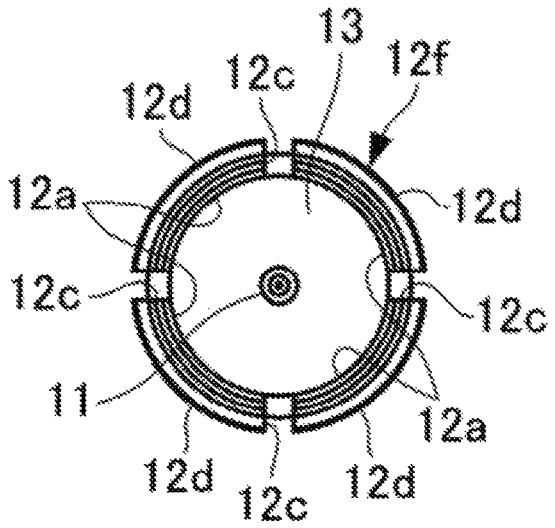
FIG. 3C is a diagram viewed along arrow C3 in FIG. 3B.

As shown in FIGS. 2 to 3C, the plug 10, which is the male connector member, includes: an internal contact 11 disposed at a radially inner position; a cylindrical shell-shaped external contact 12 extending in the axial direction and disposed at a radially outer position; and a thick cylindrical insulator 13 disposed between the internal contact 11 and the external contact 12.

As shown in FIGS. 3A, 3B, 3C and 5, the internal contact 11 of the plug 10 integrally includes: a penetration part 11*a* having a generally circular cross-section, which is formed by a wire rod-shaped conductor and penetrates the center of the insulator 13; and a first male mating part 11*b* (a projecting end part) formed to have a diameter smaller than that of the penetration part 11*a* and projecting more toward one side (the left side in FIG. 1) in the axial direction than the insulator 13. The tip of the first male mating part 11*b* has a generally conical shape. The internal contact 11 projects more toward the one side in the axial direction than the external contact 12, and one end face 31*a* of a first insulator part 31 is disposed between the tip of the internal contact 11 and the tip of the external contact 12 in an insertion direction when the plug 10 is mated with the receptacle 20 (hereinafter, referred to simply as a mating direction).

As shown in FIGS. 1, 6A, 6B and 6C, the receptacle 20, which is the female connector member, includes: an internal contact 21 and an external contact 22 arranged coaxially with each other; and a thick generally cylindrical insulator 23 made of an insulating material (a dielectric material) and disposed between the internal contact 21 and the external contact 22.

The internal contact 21 includes a slotted socket-shaped first female mating part 21*b* to create protrusion-recess mating with the first male mating part 11*b* of the internal contact 11 in the plug 10. The internal contact 21 is accommodated in the insulator 23.

The external contact 22 has a tubular (cylindrical) shell shape and is disposed at a position radially outward of the internal contact 21. The external contact 22 projects more toward the other side (the right side in FIG. 6A) in the axial direction than the internal contact 21 and the insulator 23 while surrounding the internal contact 21 and the insulator 23.

As shown in FIGS. 1 to 4B, the external contact 12 of the plug 10, which is the male connector member, includes a second male mating part 12*f* to be mated with its corresponding counterpart contact 22 at a predetermined radial contact pressure at a position closer to the front end of the external contact 12 in the mating direction but posterior (the right side in FIG. 1) to the first male mating part 11*b* of the internal contact 11 in the mating direction.

As counterpart contacts corresponding to the internal contact 11 and the external contact 12 of the plug 10, the receptacle 20, which is the female connector member, includes a second female mating part 22*f* to be mated with the second male mating part 12*f* of the external contact 12 at a predetermined radial contact pressure in addition to the first female mating part 21*b* to be mated with the first male mating part 11*b* of the internal contact 11 at a predetermined radial contact pressure.

As just described, the plug 10 (the male connector member) in the present embodiment includes, on the one side (the left side in FIG. 1) of at least one of, e.g., both of, the internal contact 11 and the external contact 12 in the axial direction, the first male mating part 11*b* and the second male mating part 12*f* to be respectively mated with the first female mating part 21*b* and the second female mating part 22*f* of the receptacle 20 at the predetermined radial contact pressures.

As shown in FIGS. 1 to 3C, the insulator 13 of the plug 10 includes: the thick generally cylindrical first insulator part 31 exposed to the one side in the axial direction; and a thick cylindrical second insulator part 32 having a diameter approximately the same as that of the first insulator part 31 and disposed on the other side in the axial direction relative to the first insulator part 31.

The one end face 31*a* of the first insulator part 31 projects more toward the one side in the axial direction than the external contact 12. The one end face 31*a* of the first insulator part 31 makes surface contact with an end face 23*a* of the thick cylindrical insulator 23 and an end face 21*a* of the internal contact 21 in the receptacle 20 at a predetermined axial contact pressure so as to have an abutted engagement state.

The first insulator part 31 has a relative permittivity equivalent to that of the second insulator part 32, which is an insulating part made of a resin. For example, the first insulator part 31 has a specific relative permittivity set within a relative permittivity range of about 2 to 5, and is made of a material capable of being readily fixed to, or integrally molded with, the second insulator part 32.

Furthermore, the first insulator part 31 is made of an elastic material capable of being elastically deformed at least in the radial direction of its generally cylindrical shape more easily than the second insulator part 32.

More specifically, the first insulator part 31 is made of, for example, either an elastomer, such as silicon rubber, capable of being integrally molded with the second insulator part 32 by a liquid injection molding (LIM) method, or a synthetic resin elastic material, such as an elastomer, capable of being molded into a generally cylindrical shape as a single component and then being bonded and fixed to the second insulator part 32 via a known adhesive. In this case, the second insulator part 32 is made of a material suitable for the LIM method such as polycarbonate.

As shown in FIGS. 1 to 4B, the second male mating part 12*f* of the external contact 12 in the plug 10 includes: a plurality of mating claw portions 12*a* disposed on the one side of the plug 10 in the axial direction and having a substantially divided cylindrical shape as a whole; and a supporting cylindrical portion 12*b* for integrally supporting the plurality of mating claw portions 12*a* at one ends thereof with a plurality of slits 12*c* being interposed between the plurality of mating claw portions 12*a*. The first insulator part 31 is disposed within a regional range closer to the one side in the axial direction than the supporting cylindrical portion 12*b* of the external contact 12. The first insulator part 31 is fixed to one end face 32*a* of the second insulator part 32 on a base end side of the plurality of mating claw portions 12*a*.

The plurality of mating claw portions 12*a* of the second male mating part 12*f* include a plurality of protrusions 12*d* that projects in a radially outward direction at equiangular intervals within the same regional range in the axial direction on their tip side. The plurality of protrusions 12*d* as a whole form a protruded shape having a generally annular shape and having tapered guides provided before and behind the protrusions 12*d*. Such a protruded shape allows the plurality of mating claw portions 12*a* to be bent by a predetermined amount in a reduced-diameter direction in accordance with an inner diameter of the second female mating part 22*f*.

Figure 5A:
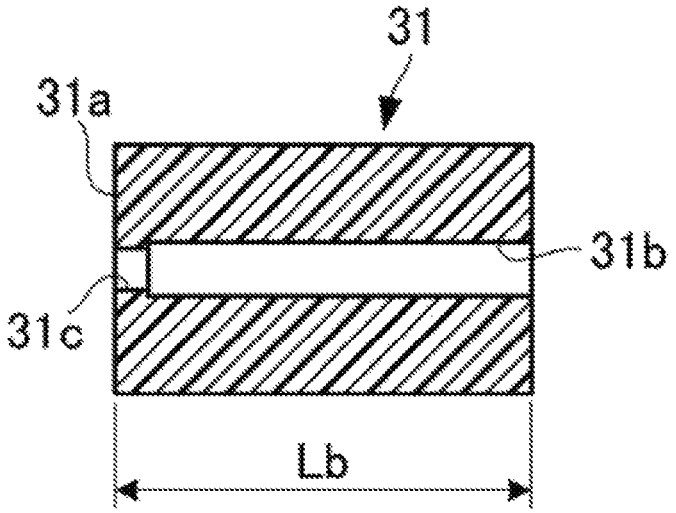
FIG. 5A is a longitudinal sectional view illustrating a first insulator part of the plug in the connector according to the first embodiment of the present invention.
Figure 5B:
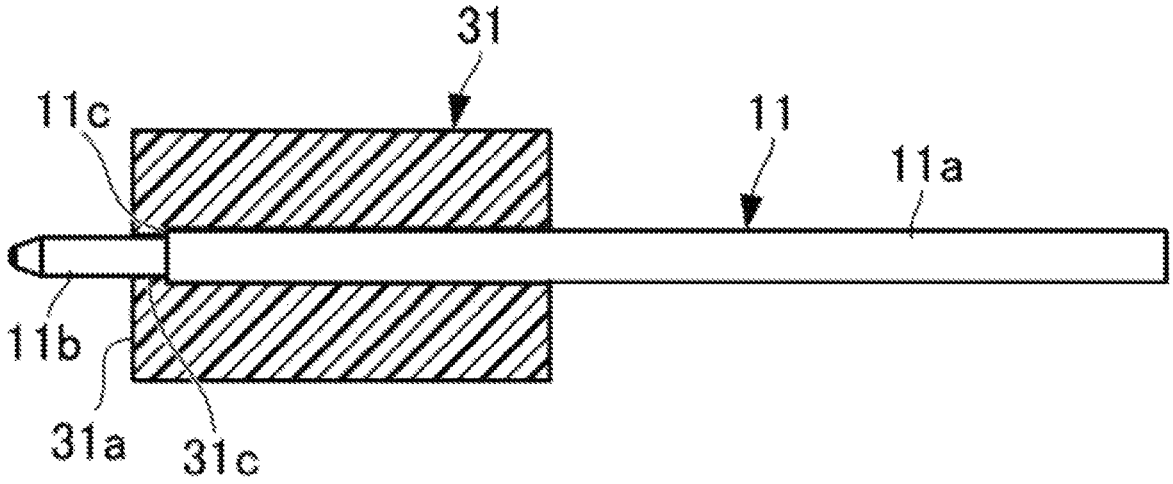
FIG. 5B is a cross-sectional view illustrating a state in which an internal contact of the plug in the connector according to the first embodiment is inserted into the first insulator part.
Figure 6A:
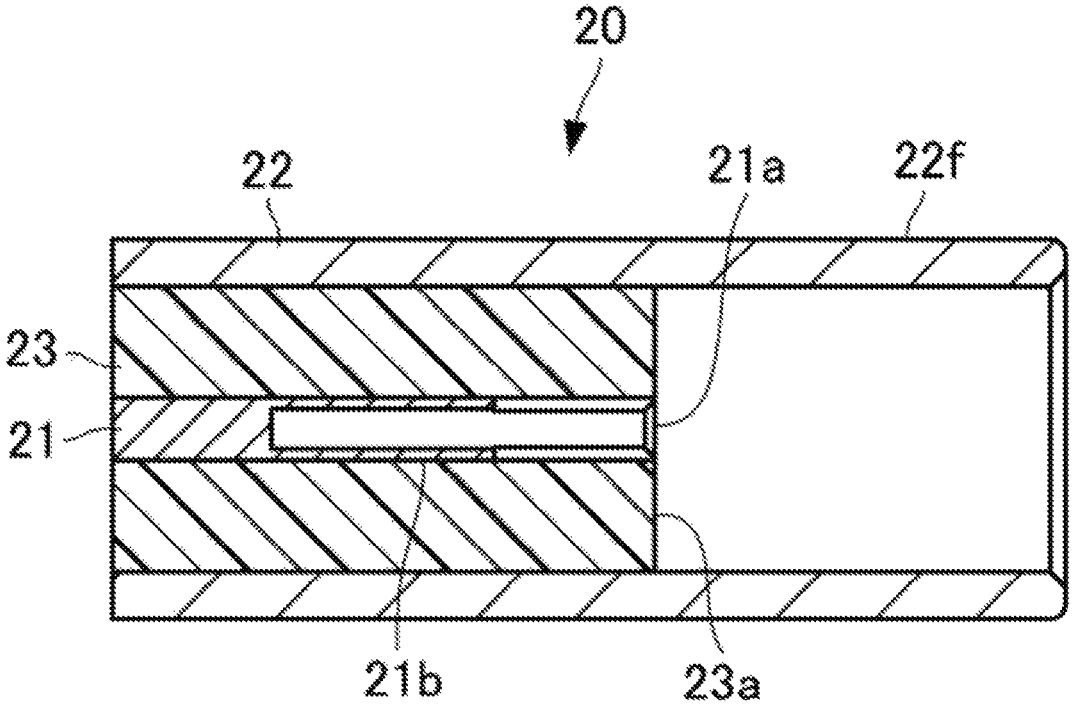
FIG. 6A is a longitudinal sectional view illustrating a part of a receptacle in the connector according to the first embodiment of the present invention.
Figure 6B:
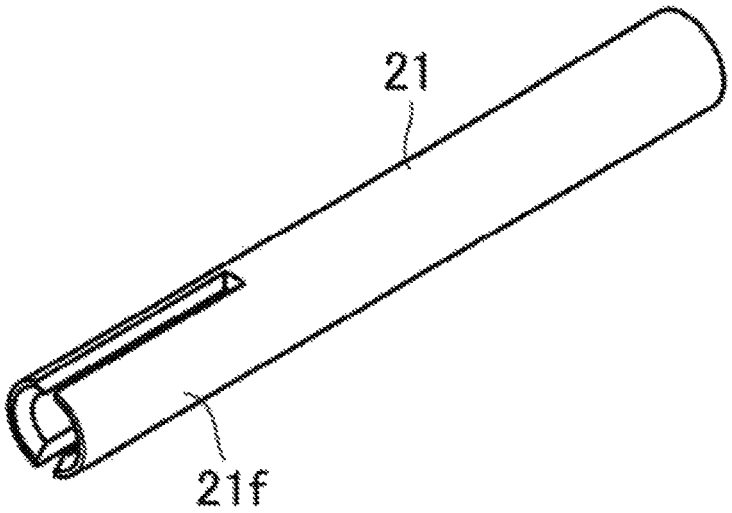
FIG. 6B is a perspective view illustrating an internal contact in a mating part of the receptacle.
Figure 6C:
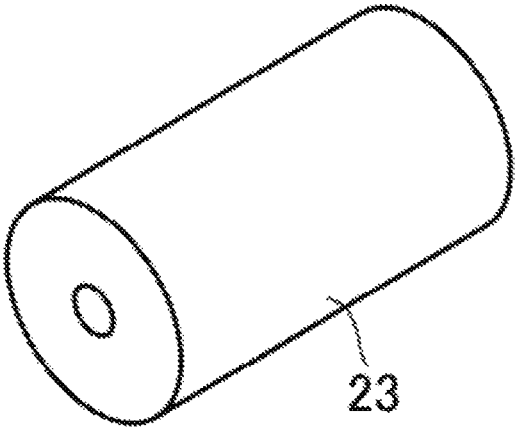
FIG. 6C is a perspective view illustrating an insulator of the receptacle.

As shown in FIG. 5A, the first insulator part 31 includes an inwardly projecting part 31*c* having a diameter smaller than that of a central hole 31*b* in the vicinity of the one end face 31*a*. As shown in FIG. 5B, the first insulator part 31 is attached to the internal contact 11 with a stepped part 11*c* provided between the penetration part 11*a* of the internal contact 11 and the first male mating part 11*b* in the plug 10 being in abutment with the inwardly projecting part 31*c* of the first insulator part 31.

With the use of the first insulator part 31 having any shape with a diameter slightly larger than an inner diameter D of the second male mating part 12*f* of the external contact 12, a portion of the first insulator part 31 in the vicinity of the one end face 31*a* is brought into abutment with the stepped part 11*c* of the internal contact 11, or the first insulator part 31 bulges out from the tip of the second male mating part 12*f* or into the plurality of slits 12*c* when the plurality of mating claw portions 12*a* of the second male mating part 12*f* are fitted into the second female mating part 22*f*. This reduces the application of a compressive load in the axial direction to the second insulator part 32 by the first insulator part 31.

The one end face 32*a* of the second insulator part 32 projects toward the one side in the axial direction (the mating direction) from the supporting cylindrical portion 12*b* in the second male mating part 12*f* of the external contact 12 by a projecting length La (see FIGS. 3A and 3B) significantly smaller than a length Lm (see FIG. 4A) from the base end to the tip of the plurality of mating claw portions 12*a*.

An axial length Lb (see FIG. 5A) of the first insulator part 31 is set to a value equal to, or slightly larger than, the mated depth Lf of the external contact 12 of the plug 10 into the receptacle 20, and the one end face 31*a* of the first insulator part 31 projects more toward the one side in the axial direction than the external contact 12.

As a result of such settings for the shape and dimensions of the first insulator part 31, the first insulator part 31, when the plurality of mating claw portions 12*a* of the second male mating part 12*f* are fitted into the second female mating part 22*f*, can be elastically recovered by following the plurality of mating claw portions 12*a* or can be bulged out into the plurality of slits 12*c* provided between the plurality of mating claw portions 12*a* after being compressed in the radial direction and the axial direction without compressing the second insulator part 32 in the radial direction.

Although the substantially divided cylindrical shape in the present embodiment refers to 90-degree division (divided into quarters) having four mating claw portions 12*a* and four slits 12*c*, any plural number of divisions can be used.

Figure 4A:
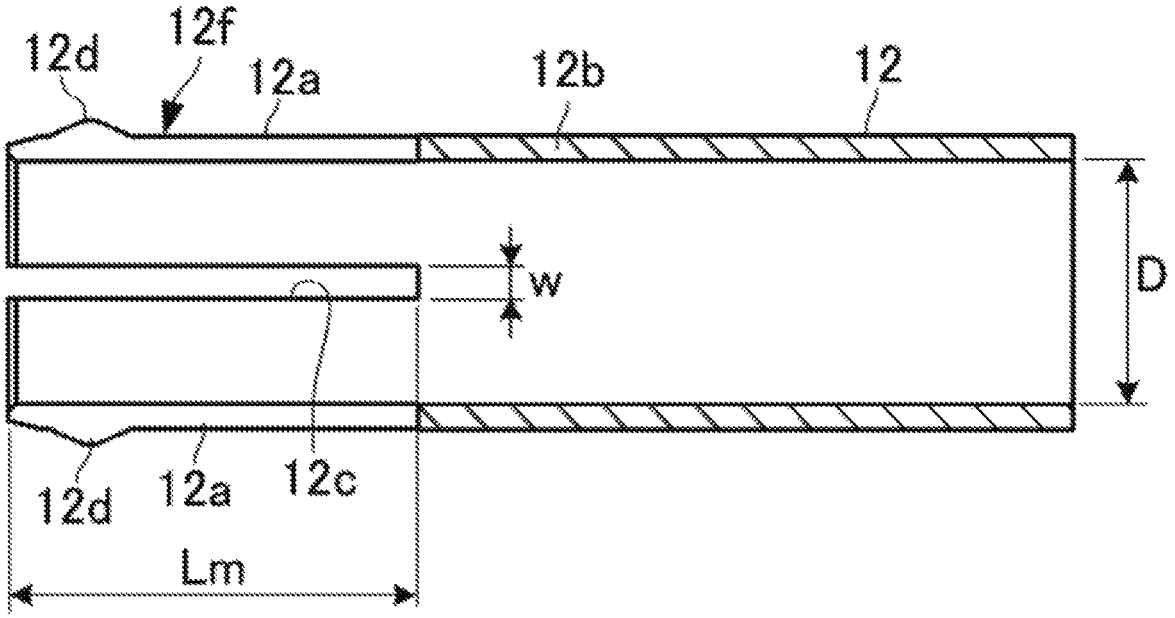
FIG. 4A is a longitudinal sectional view illustrating a part of an external contact of the plug in the connector according to the first embodiment of the present invention.
Figure 4B:
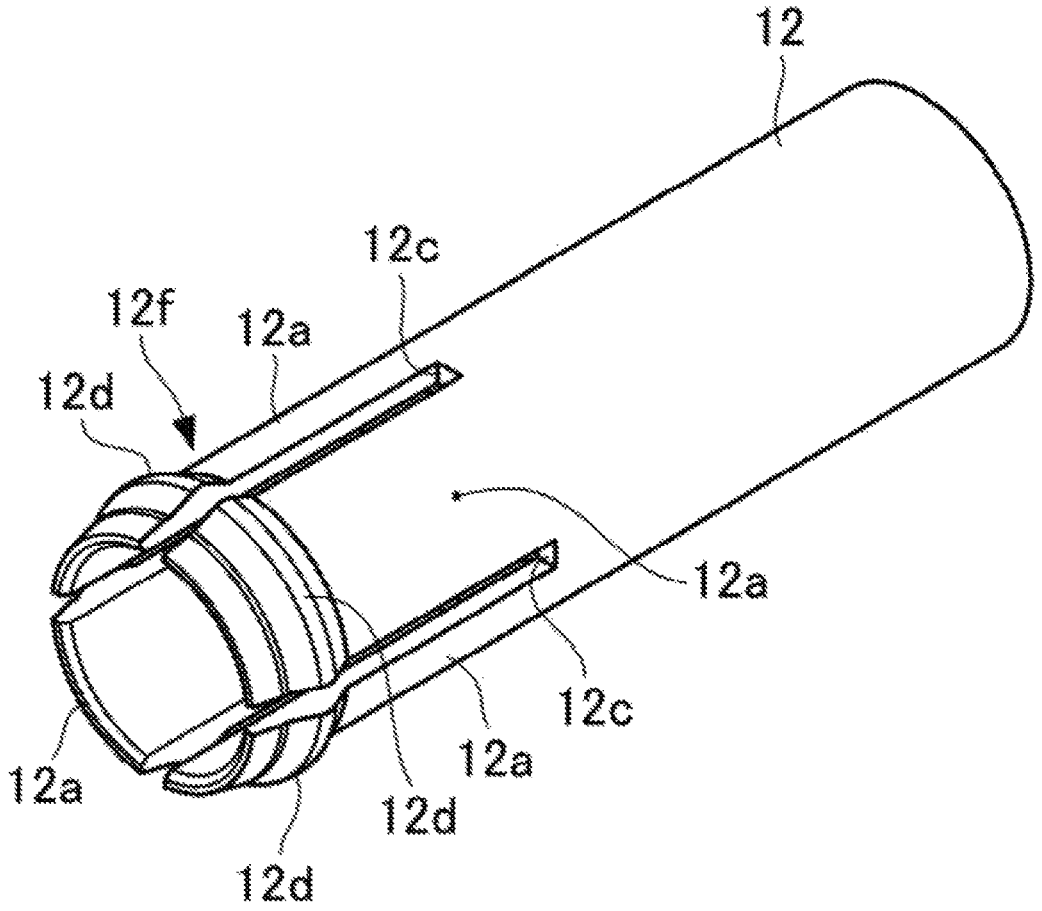
FIG. 4B is a perspective view illustrating a part of the external contact.

As shown in FIG. 4A, widths w of the plurality of slits 12*c* in the circumferential direction of the external contact 12 of the plug 10 are equal to one another and substantially constant over the range of the length Lm from the base end to the tip of the plurality of mating claw portions 12*a* supported by the supporting cylindrical portion 12*b*. Note that the widths w of the plurality of slits 12*c* in the external contact 12 may be unequal to one another, or may be non-constant from the base end to the tip of the plurality of mating claw portions 12*a*.

As just described, the plug 10 and the receptacle 20 include the second male mating part 12*f* and the second female mating part 22*f*, which together create protrusion-recess mating with the mated depth Lf, in their external contacts 12 and 22. The plug 10 and the receptacle 20 also include the first male mating part 11*b* and the first female mating part 21*b*, which together create protrusion-recess mating on an inner side of the receptacle 20 relative to the mated depth Lf, in their internal contacts 11 and 21. The first female mating part 21*b* of the receptacle 20 has a recess depth larger than the length of the first male mating part 11*b* of the plug 10, and an inner diameter slightly larger than the outer diameter of the first male mating part 11*b*.

Effects will be described next.

In the thus configured present embodiment, early in the process of inserting the plug 10 into the receptacle 20 in the mating direction, the external contact 12 of the plug 10 initially mated with the second female mating part 22*f* of the receptacle 20 is bent in the radial direction.

At this time, the first insulator part 31 capable of being easily deformed elastically can facilitate elastic deformation and elastic recovery for the mating of the external contact 12 with the counterpart contact, and can effectively reduce the creation of a gap between the insulator 13 and the internal contact 11 or the external contact 12 after the elastic recovery of the external contact 12. As the result, deterioration in characteristic impedance due to permittivity change resulting from the creation of such a gap space can be effectively reduced.

Moreover, when the second male mating part 12*f* of the plug 10 is mated with the second female mating part 22*f* of the receptacle 20 in the present embodiment, the plurality of mating claw portions 12*a* are bent in the radial direction to compress the first insulator part 31 and elastically recovered together with the first insulator part 31. Thus, the operation of mating the plug 10 with the receptacle 20 can be facilitated, and the creation of a gap space between the insulator 13 and the internal contact 11 or the external contact 12, which may lead to permittivity change, can be reduced more effectively.

Furthermore, since the first insulator part 31 has a relative permittivity equivalent to that of the second insulator part 32 in the present embodiment, deterioration in characteristic impedance in the mating parts of the plug 10 and the receptacle 20 in the connector 1 can be effectively reduced.

In addition, since the first insulator part 31 is integrally coupled to the second insulator part 32 in the present embodiment, the first insulator part 31 can be disposed at a stable position and with a stable orientation as well as in a required filled shape relative to the second insulator part 32, the internal contact 11, and the external contact 12 so as not to create a gap in the insulator layer.

Moreover, since the one end face 31*a* of the first insulator part 31 in the plug 10 projects more toward the one side in the axial direction than the external contact 12 of the plug 10, the one end face 31*a* of the first insulator part 31 is brought into contact with the insulator 23 of the receptacle 20 earlier than the external contact 12. Thus, the insulators 13 and 23 of the plug 10 and the receptacle 20 are disposed in a connected state via the first insulator part 31 provided therebetween without any gap not only in the radial direction but also in the axial direction.

As just described, the shape and orientation of the first insulator part 31 in the male-female mating state can be stably maintained, and contact between the internal contacts 11 and 21 of the plug 10 and the receptacle 20 as well as contact between the external contacts 12 and 22 thereof can be stably maintained in the present embodiment. Thus, deterioration in characteristic impedance of a transmission path due to capacitor change resulting from crush or clearance of the insulators 13 and 23 in the mating parts can be effectively reduced.

Example 1

A connector 1 having the above-described configuration of the first embodiment was produced. In this connector 1, the first insulator part 31 was made of silicon rubber, and the first insulator part 31 and the second insulator part 32 in the insulator 13 were integrally molded by the LIM method. The relative permittivity of each of the insulator 13 of the plug 10 and the insulator 23 of the receptacle 20 was set to 3.5, and a characteristic impedance Z was set to 50Ω. Measurements on propagation delay were made according to time-domain reflectometry (TDR).

Figure 7:
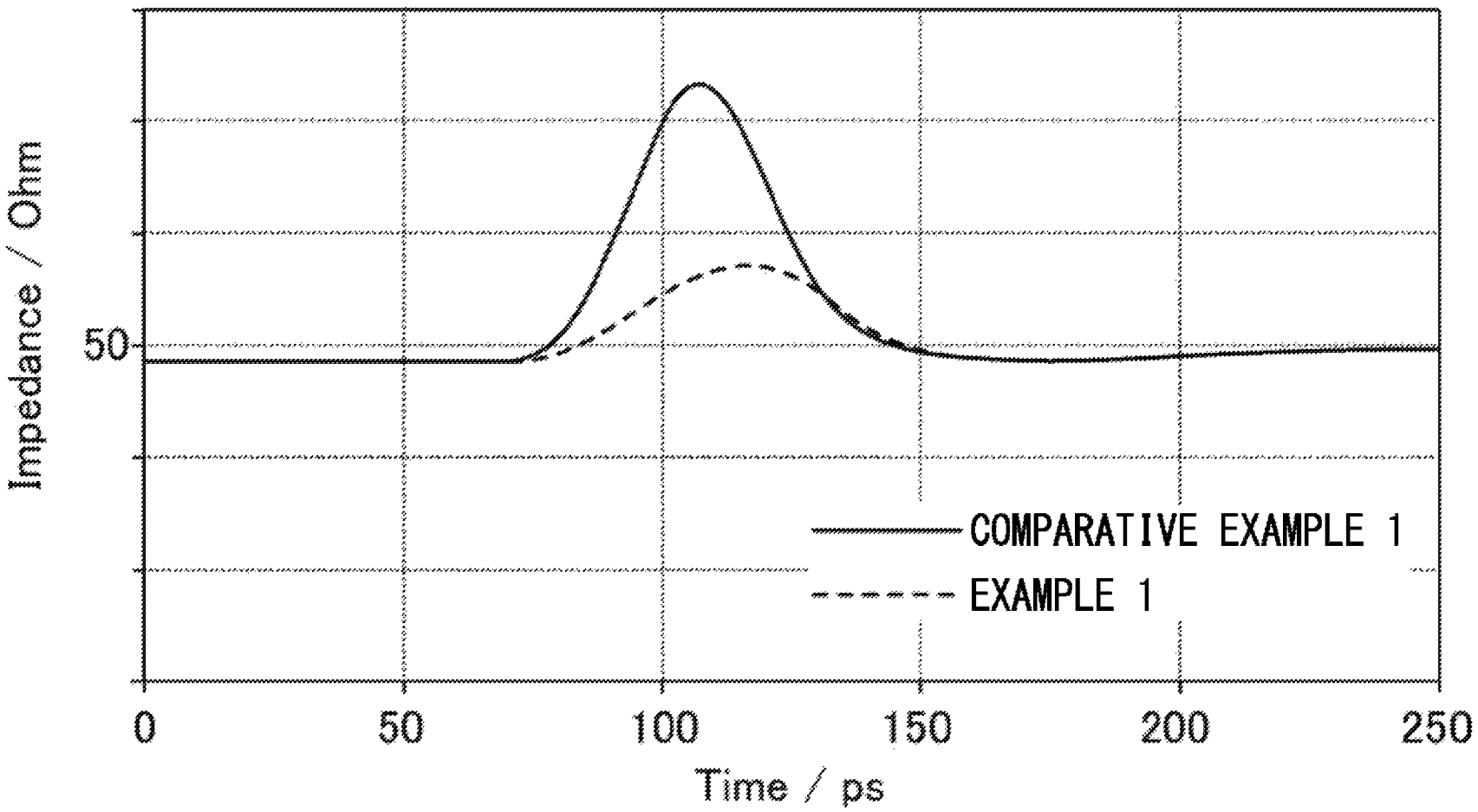
FIG. 7 is a graph showing a result of time-domain reflectometry measurements made on a connector of Example 1 having the configuration of the connector according to the first embodiment of the present invention so as to be comparable to a comparative example without the provision of an elastic material as in the first insulator part, wherein the vertical axis thereof represents an impedance and the horizontal axis thereof represents a delay time corresponding to a signal delay amount by a measured element.

FIG. 7 shows the result of the measurements via a graph having the vertical axis representing an impedance (Ω) and the horizontal axis representing a delay time (ps). The dotted line in FIG. 7 represents Example 1, whereas the solid line represents Comparative Example 1 in which an insulator of a plug was made up solely of the same insulating material as the second insulator part 32 of Example 1, and a gap necessary to permit bending upon the insertion of the plug was provided in the vicinity of an inner peripheral surface of the second male mating part 12*f* of the external contact 12.

As is apparent from FIG. 7, in both of Comparative Example 1 and Example 1, a portion of a propagation delay time region corresponding to its transmission path length excluding a delay section corresponding to its connector mating part had a characteristic impedance of about 50Ω. In the section corresponding to the connector mating part, in contrast, increase (pronounced increase especially in Comparative Example 1) in characteristic impedance due to reflection occurred. The increase in characteristic impedance in Example 1, however, was reduced to less than half of that in Comparative Example 1.

Thus, it can be recognized that Example 1 having the first insulator part 31 capable of being easily deformed elastically in the radial direction as compared to the second insulator part 32 can provide a connector capable of effectively reducing deterioration in characteristic impedance of the transmission path.

Second Embodiment

Figure 8:
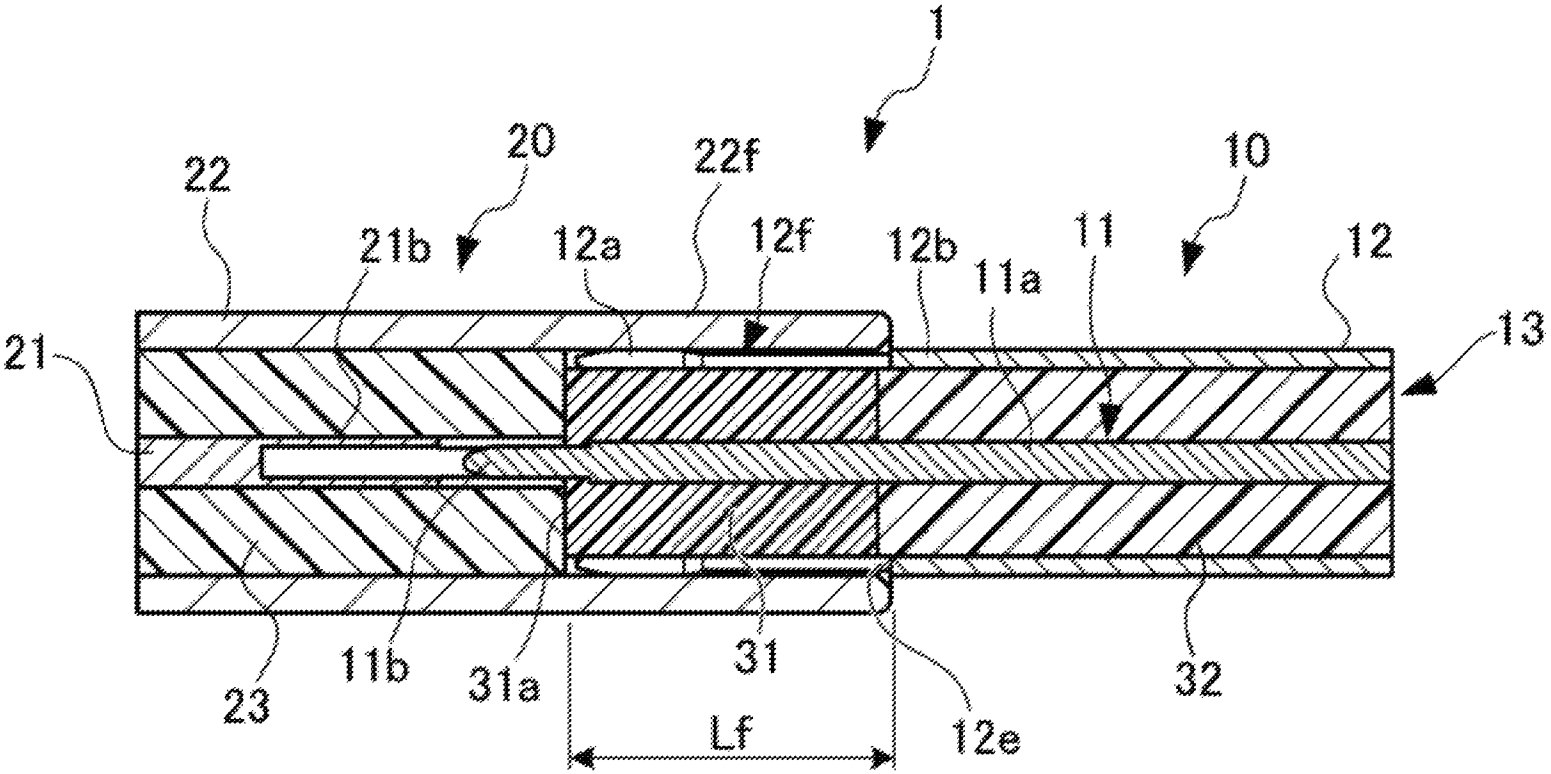
FIG. 8 is a longitudinal sectional view illustrating a part of a connector according to a second embodiment of the present invention.
Figure 9A:
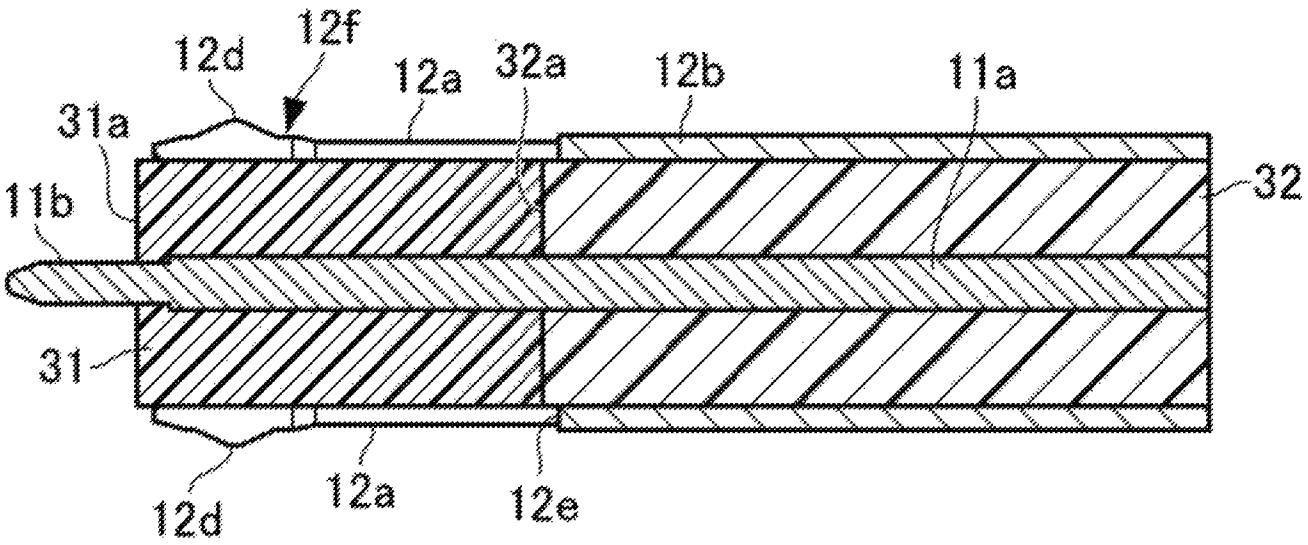
FIG. 9A is a longitudinal sectional view illustrating a part of a plug in the connector according to the second embodiment of the present invention.
Figure 9B:
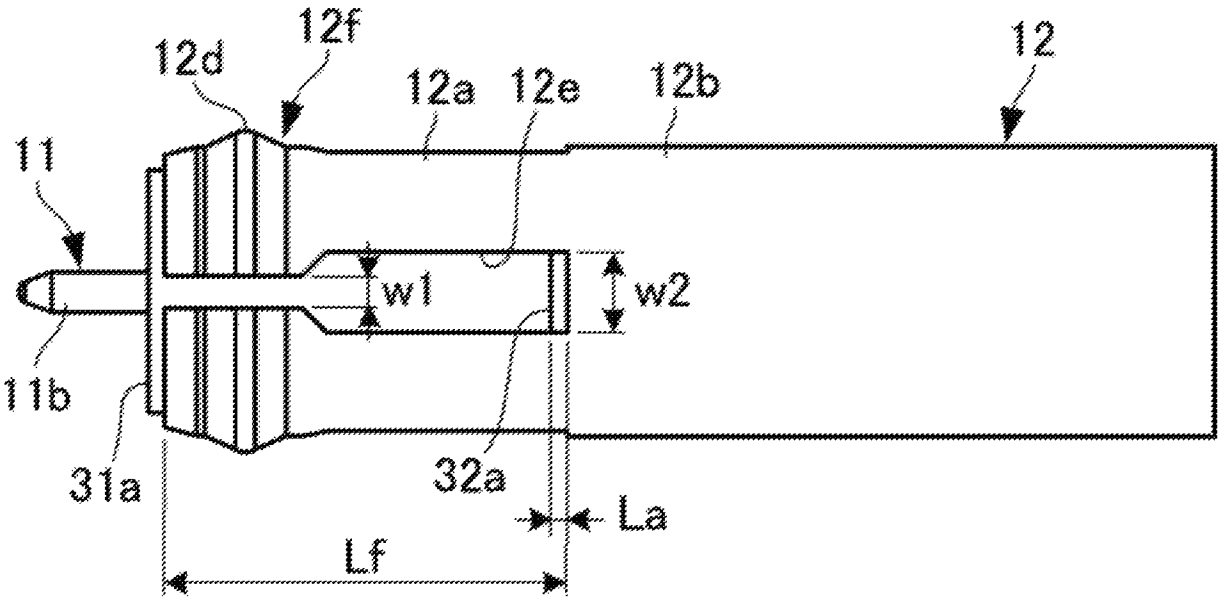
FIG. 9B is a side view illustrating the part of the plug.
Figure 9C:
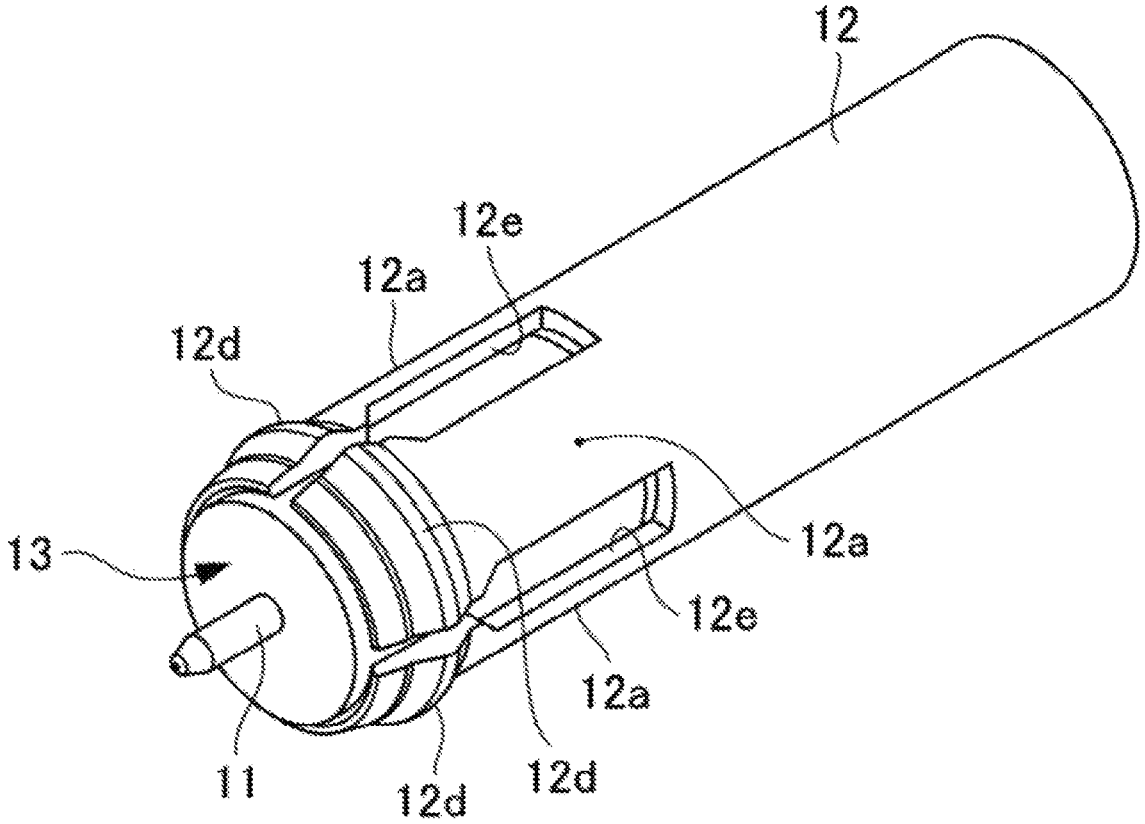
FIG. 9C is a perspective view illustrating the part of the plug.

FIGS. 8 to 9C illustrate a connector according to a second embodiment of the present invention.

As shown in these figures, the second embodiment has a configuration generally the same as that of the above-described connector 1 of the first embodiment except for the configuration of a second male mating part 12*f* in an external contact 12 of a plug 10.

A receptacle 20, which is a female connector member, includes, as corresponding counterpart contacts, a first female mating part 21*b* to be mated with a first male mating part 11*b* of an internal contact 11 at a predetermined radial contact pressure, and a second female mating part 22*f* to be mated with the second male mating part 12*f* of the external contact 12 at a predetermined radial contact pressure.

As shown in FIGS. 8 to 9C, in the second male mating part 12*f* of the external contact 12 according to the present embodiment, widths of a plurality of slits 12*e* are each set to have a larger width w2 on the base end side of a plurality of mating claw portions 12*a* supported by a supporting cylindrical portion 12*b* and to have a smaller width w1 on the tip side of the plurality of mating claw portions 12*a*.

Since a first insulator part 31 can be easily deformed elastically as compared to a second insulator part 32, effects similar to those of the first embodiment can be obtained also in this embodiment.

Additionally, a required bending amount and strength of the plurality of mating claw portions 12*a* can be attained in the present embodiment without providing, for example, a hole to cause stress concentration in the plurality of mating claw portions 12*a* of the second male mating part 12*f*. Moreover, when the plurality of mating claw portions 12*a* are bent in the radial direction to compress the first insulator part 31, the first insulator part 31 can be partially bulged out into the slits 12*e* on the base end side of the plurality of mating claw portions 12*a*. This makes it possible to reduce the creation of a gap space between an insulator 13 and the internal contact 11 or the external contact 12 more effectively while reliably permitting the required bending of the plurality of mating claw portions 12*a*. Furthermore, the application of a load to the second insulator part 32 can be reduced more effectively.

Third Embodiment

Figure 10:
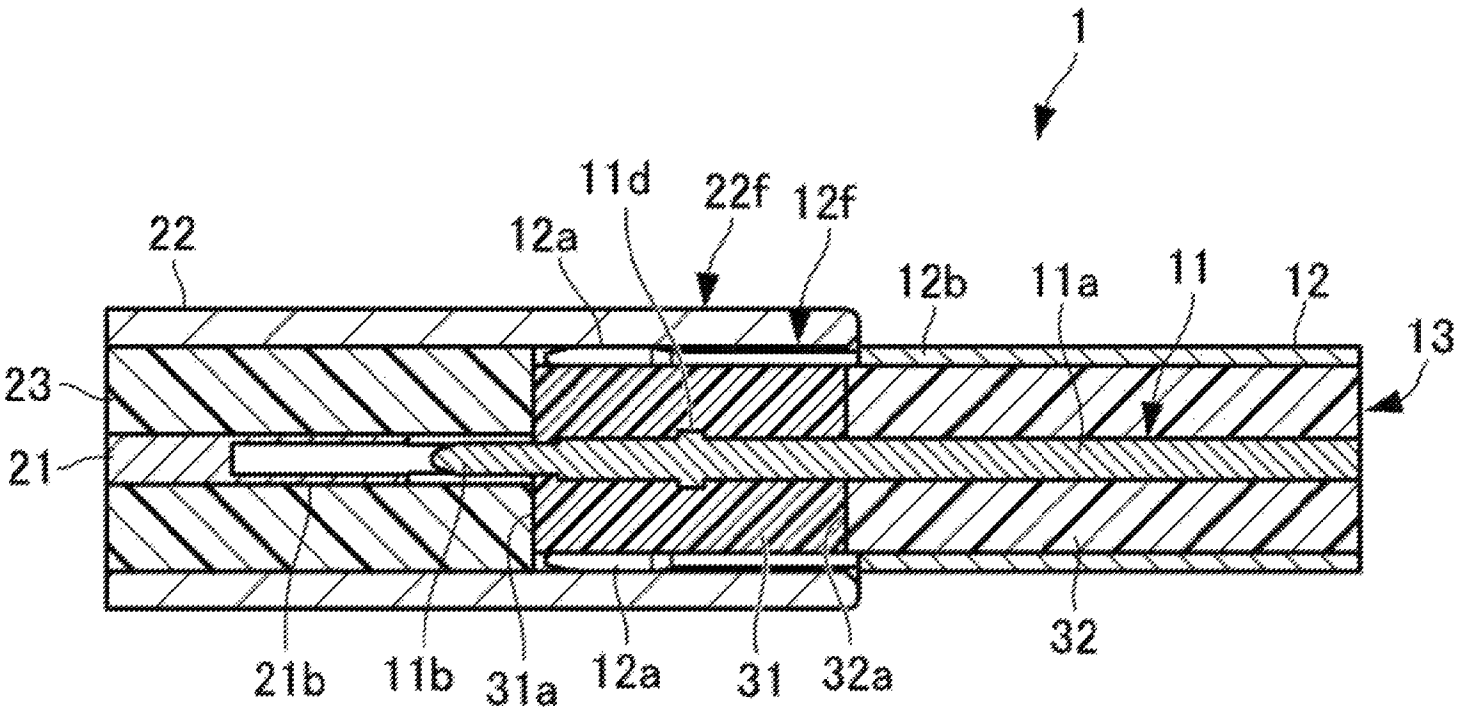
FIG. 10 is a longitudinal sectional view illustrating a part of a connector according to a third embodiment of the present invention.
Figure 11A:
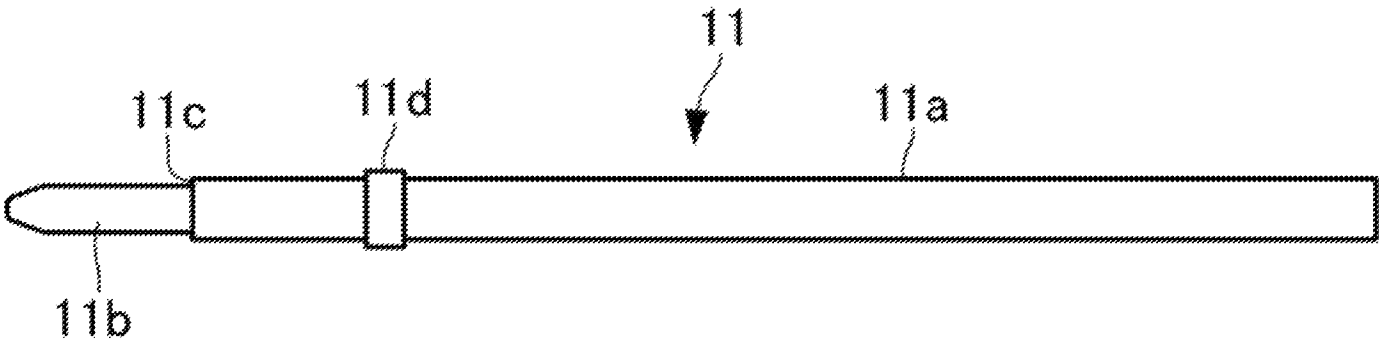
FIG. 11A is a side view of an internal contact in the connector according to the third embodiment of the present invention.
Figure 11B:
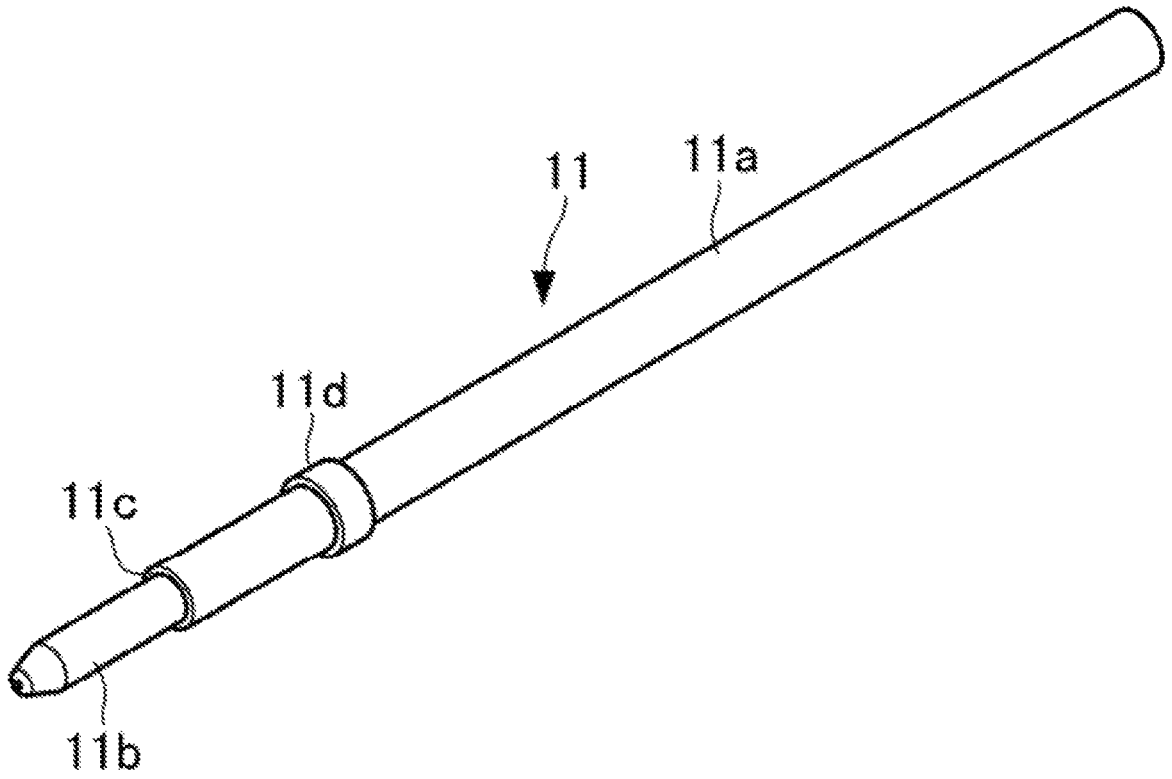
FIG. 11B is a perspective view illustrating a part of the internal contact in the connector according to the third embodiment.
Figure 12:
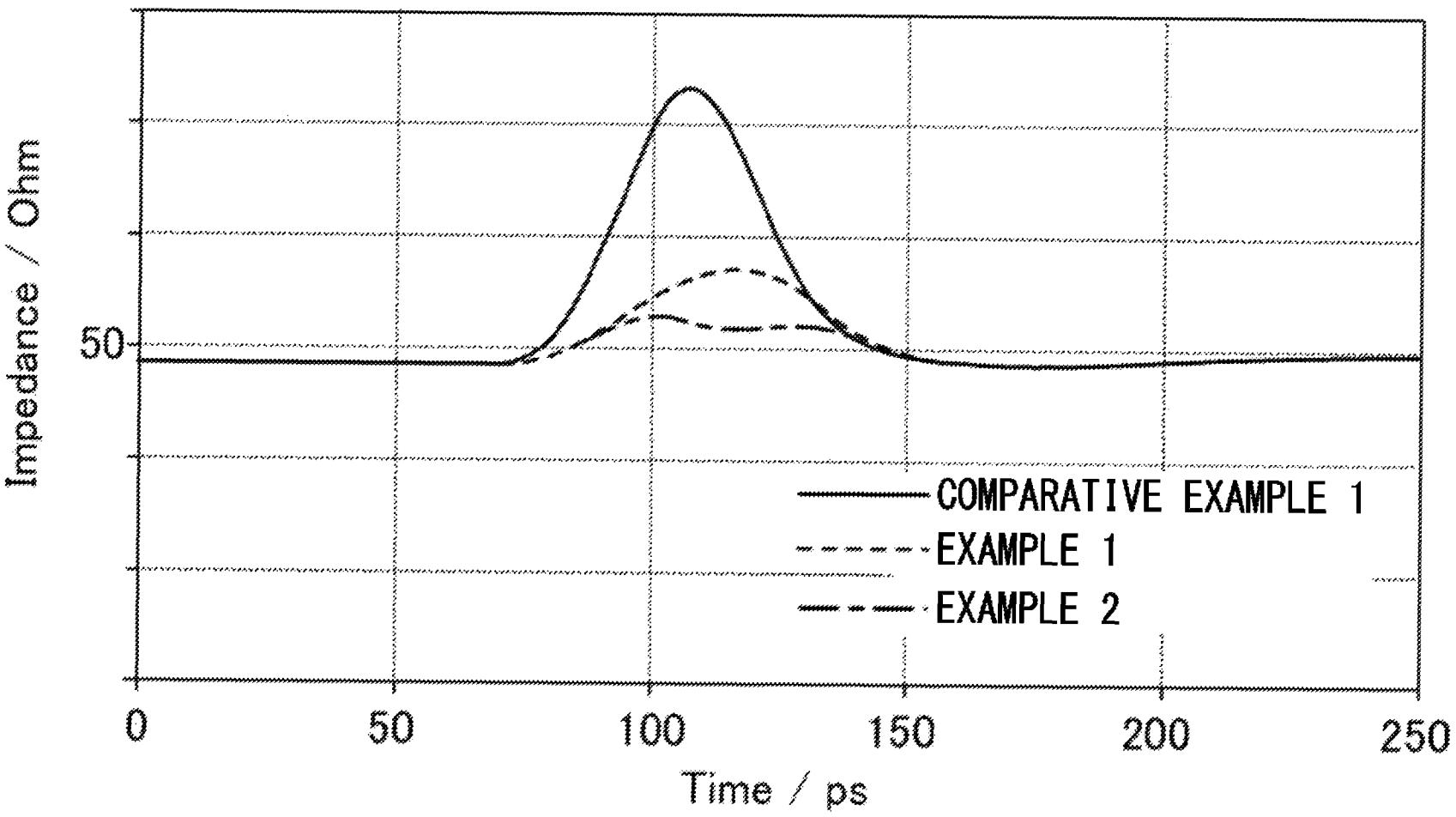
FIG. 12 is a graph showing a result of time-domain reflectometry measurements made on the connector according to the third embodiment of the present invention so as to be comparable to the comparative example and the first embodiment, wherein the vertical axis thereof represents an impedance and the horizontal axis thereof represents a delay time corresponding to a signal delay amount by a measured element.

FIGS. 10 to 12 illustrate a connector according to a third embodiment of the present invention.

As shown in these figures, the third embodiment has a configuration generally the same as that of the above-described connector 1 of the second embodiment except that the configuration of an internal contact 11 of a plug 10 differs from those in the above-described first and second embodiments, and the configuration of an external contact 12 is different from that in the above-described first embodiment but generally the same as that in the second embodiment. Note that the configuration of a receptacle 20, which is a female connector member, is the same as those in the first and second embodiments.

As shown in FIGS. 10 to 11B, in addition to a penetration part 11*a* that penetrates an insulator 13, a first male mating part 11*b* projecting more toward one side in the axial direction than a first insulator part 31, and a stepped part 11*c* provided between the penetration part 11*a* and the first male mating part lib, the internal contact 11 of the plug 10 in this embodiment includes a protrusion 11*d* that protrudes in the radial direction toward the first insulator part 31 from the penetration part 11*a* at a position farther away from the first male mating part 11*b* than the stepped part 11*c*.

Since the first insulator part 31 can be easily deformed elastically as compared to a second insulator part 32, effects similar to those of the first embodiment can be obtained also in this embodiment.

Additionally, even when the first insulator part 31 is brought into elastic abutment with an insulator 23 of the counterpart receptacle 20 upon the insertion of a plurality of mating claw portions 12*a* of a second male mating part 12*f* into a second female mating part 22*f* in the present embodiment, an axial displacement of the first insulator part 31 can be restricted by the protrusion 11*d* of the internal contact 11 in addition to, for example, the vicinity of one end face 31*a* of the first insulator part 31 abutting against, and thereby being held by, the stepped part 11*c* of the internal contact 11 as with the first and second embodiments. Thus, no gap is created, for example, in the portion where the insulators 13 and 23 abut against each other, and no large load is applied to the second insulator part 32.

Example 2

A connector 1 having the above-described configuration of the third embodiment was produced. In this connector 1, the first insulator part 31 was made of silicon rubber, and the first insulator part 31 and the second insulator part 32 in the insulator 13 were integrally molded by the LIM method. The relative permittivity of each of the insulator 13 of the plug 10 and the insulator 23 of the receptacle 20 was set to 3.5, and a characteristic impedance Z was set to 50Ω. Measurements on propagation delay were made according to time-domain reflectometry (TDR).

FIG. 12 shows the result in comparison with Comparative Example 1 and Example 1 described above via a graph having the vertical axis representing an impedance (Ω) and the horizontal axis representing a delay time (ps). The alternate long and short dash line in FIG. 12 represents the result of Example 2.

As is apparent from FIG. 12, in all of Comparative Example 1, Example 1, and Example 2, a portion of a propagation delay time region corresponding to its transmission path length excluding a delay section corresponding to its connector mating part had a characteristic impedance of about 50Ω. In the section corresponding to the connector mating part, in contrast, increase (pronounced increase especially in Comparative Example 1) in characteristic impedance due to reflection occurred as mentioned above. The increase in characteristic impedance in Example 1 was reduced to less than half of that in Comparative Example 1, and the increase in characteristic impedance in Example 2 was reduced to about one-fifth of that in Comparative Example 1 (about half of that in Example 1).

Thus, it can be recognized that Example 2 can also provide a connector capable of effectively reducing deterioration in characteristic impedance of the transmission path.

Although the insulator 13 of the plug 10 includes the first insulator part 31 in each of the above-described embodiments, the insulator 23 of the receptacle 20 may alternatively include a first insulator part made of an elastic material and exposed to the plug 10, and a second insulator part disposed at a position farther away from the plug 10 than the first insulator part. In this case, it is also conceivable that the exposed end face of the first insulator part in the receptacle projects more toward the mating direction (one side in the axial direction) than the internal contact.

Moreover, when the internal contact and the external contact both have a cylindrical shape, an end face of the first insulator part filled between those contacts only needs to project more toward the front side in the mating direction than the contact disposed posteriorly in the mating direction of the internal and external contacts having different end face positions in the axial direction.

Furthermore, although the above-described embodiments each illustrate the internal and external contacts having circular cross-sectional shapes, the internal and external contacts may have non-circular cross-sectional shapes. Also, the material and cross-sectional shape of the first insulator part 31, and the material and the like of the second insulator part 32 are not limited to those described above.

As described above, the embodiment(s) of the present invention can provide the connector capable of effectively reducing deterioration in characteristic impedance of the transmission path due to capacitor change resulting from crush or clearance of the insulators in the mating parts of the connector. The embodiment(s) of the present invention are useful for connectors in general including internal and external lines that constitute a transmission path and an insulator provided between these lines.

REFERENCE SIGNS LIST

1 connector
10 plug (male connector member)
11 internal contact
11*a* penetration part
11*b* first male mating part (mating part)
11*c* stepped part
11*d* protrusion
12 external contact
12*a* mating claw portion
12*b* supporting cylindrical portion
12*c*, 12*e* slit
12*d* protrusion
12*f* second male mating part (mating part)
13 insulator (insulator on the plug side)
20 receptacle (female connector member)
21 internal contact (counterpart contact)
21*b* first female mating part
22 external contact (counterpart contact)
22*f* second female mating part
23 insulator
23*a* end face
31 first insulator part
31*a* one end face
31*b* central hole
31*c* inwardly projecting part
32 second insulator part
W, w1, w2 width

The invention claimed is:

1. A connector comprising:

an internal contact extending in an axial direction and disposed at an inner position in a radial direction;

an external contact extending in the axial direction and disposed at an outer position in the radial direction; and an insulator disposed between the internal contact and the external contact, wherein at least one of the internal contact and the external contact includes, on one side in the axial direction, a mating part to be mated with a corresponding counterpart contact at a predetermined radial contact pressure, the insulator includes a first insulator part exposed to the one side in the axial direction, and a second insulator part disposed on the other side in the axial direction relative to the first insulator part, and the first insulator part is made of an elastic material capable of being easily deformed elastically in the radial direction as compared to the second insulator part;

wherein one end face of the first insulator part projects more toward the one side in the axial direction than the external contact.

2. The connector according to claim 1, wherein the mating part includes a plurality of mating claw portions disposed on the one side in the axial direction and having a substantially divided cylindrical shape as a whole, and a supporting cylindrical portion for integrally supporting the plurality of mating claw portions at one ends thereof with a plurality of slits being interposed between the plurality of mating claw portions, and the first insulator part is disposed within a regional range closer to the one side in the axial direction than the supporting cylindrical portion.

3. The connector according to claim 2, wherein widths of the plurality of slits are each set to have a larger width on a base end side of the plurality of mating claw portions supported by the supporting cylindrical portion and to have a smaller width on a tip side of the plurality of mating claw portions.

4. The connector according to claim 1, wherein the internal contact includes a penetration part that penetrates the insulator, a projecting end part that projects more toward the one side in the axial direction than the first insulator part, and a protrusion that protrudes in the radial direction toward the first insulator part from the penetration part.

5. The connector according to claim 1, wherein the first insulator part has a relative permittivity equivalent to that of the second insulator part.

6. The connector according to claim 1, wherein the first insulator part is integrally coupled to the second insulator part.

7. A connector comprising a male connector member and a female connector member, each including: an internal contact extending in an axial direction and disposed at an inner position in a radial direction; an external contact extending in the axial direction and disposed at an outer position in the radial direction; and an insulator disposed between the internal contact and the external contact, wherein the male connector member of the male and female connector members includes first and second male mating parts to be mated with corresponding counterpart contacts at a predetermined radial contact pressure, the female connector member of the male and female connector members includes first and second female mating parts to be mated with corresponding counterpart contacts at a predetermined radial contact pressure, the insulator of the male connector member includes a first insulator part exposed to one side in the axial direction, and a second insulator part disposed on the other side in the axial direction relative to the first insulator part, and the first insulator part is made of an elastic material capable of being easily deformed elastically in the radial direction as compared to the second insulator part;

wherein one end of the first insulator part of the male connector member projects more toward the one side in the axial direction than the external contact of the male connector member.

8. The connector according to claim 7, wherein the internal contact of the male connector member projects more toward the one side in the axial direction than the first insulator part and the external contact of the male connector member to form the first male mating part, and the internal contact of the female connector member includes a first female mating part with a length in the axial direction larger than or equal to that of the first male mating part.

* * * * *